US005670971A

United States Patent [19]

Tokimoto et al.

[11] Patent Number: 5,670,971

[45] Date of Patent: Sep. 23, 1997

[54] SCAN TYPE DISPLAY DEVICE WITH IMAGE SCANNING FUNCTION

[75] Inventors: Toyotaro Tokimoto, Yokohama; Hiroshi Yajima, Zushi, both of Japan

[73] Assignee: Avix Inc., Yokohama, Japan

[21] Appl. No.: 359,211

[22] Filed: Dec. 19, 1994

[30] Foreign Application Priority Data

Sep. 26, 1994 [JP] Japan ..... 6-229831

[51] Int. Cl.[6] ..... G09G 3/20

[52] U.S. Cl. ..... 345/31; 345/39

[58] Field of Search ..... 345/30, 31, 33, 345/34, 39, 96

[56] References Cited

U.S. PATENT DOCUMENTS 3,958,235 5/1976 Duffy ..... 345/31

5,406,300 4/1995 Tokimoto et al. ..... 345/39

*Primary Examiner*—Mark R. Powell

*Attorney, Agent, or Firm*—Pennie & Edmonds LLP

[57] ABSTRACT

A scan type display device has a device body carrying a light emitting cell array, in which a plurality of light emitting cell arrays are aligned on a line, for scanning aerial plane to display a desired image by residual image effect. The light emitting cells are selectively illuminated according to an image data stored in a memory in synchronism with motion of the device body. The display device also has at least one light receiving element provided on the device body in a positional relationship with the light emitting cell array in such a manner that, when an image carrying medium containing an image to be sampled is placed in close proximity to the light emitting cell array in opposition and the light emitting cells in the light emitting cell array are selectively illuminated, a reflected light from the image carrying medium is received by the light receiving element for sampling the image on the image carrying medium. When an image carrying medium is placed in close proximity to the light emitting cell array in opposition, each individual light emitting cell is illuminated in order for locally irradiating light on the image carrying medium for reading output the light receiving element for sampling image data of a linear image fraction, and by relatively shifting the image carrying medium and the light emitting array for repeating sampling of image data for other linear image fraction to establish an image data of the two-dimensional image.

14 Claims, 10 Drawing Sheets

SCAN TYPE DISPLAY DEVICE WITH IMAGE SCANNING FUNCTION

BACKGROUND OF THE INVENTION

1. Field of the Invention

The present invention relates generally to a scan type display device for aerially displaying an image utilizing afterimage effect by manually or mechanically scanning a line form display device (light emitting cell array), in which a plurality of light emitting cells are arranged in alignment on a line. More specifically, the invention relates to a scan type display device having a function for scanning and reading an image to be displayed from a printed or drafted original image.

2. Description of the Related Art

The scan type display device has been proposed in a commonly owned European Patent First Publication No. 05 46 844, published on Jun. 16, 1993 (corresponding to U.S. Patent Application that has now been pending under Ser. No. 07/991,547, filed on Dec. 11, 1992). The disclosed swing or scan type aerial display system is adapted to aerially display a desired visual image utilizing a residual image effect of a moving light emitting array. In order to establish synchronization of the motion of said moving light emitting array and illuminating timing of individual cells in the light emitting array, the motion behavior of the system is monitored and timing to drive each individual cell is controlled in relation to the monitored motion behavior of the light emitting array, so that the desired image becomes visible at a desired position and desired configuration. The aerial display system includes a display control circuit having a memory for storing an image data corresponding to the image to be displayed. The display control circuit receives the output of a sensor monitoring the swing motion of the light emitting array for selectively illuminating the individual cells in synchronism with the swing motion to aerially display the desired image. Namely, the display control circuit reads out an image data in a bit map format in a predetermined order per line to line at an appropriate speed for driving the individual cells to illuminate and obscure depending on the lighting pattern at respective lines in synchronism with the swing motion of the main body. Then, by the afterimage or residual image effect, aerial image can be displayed in the aerial space.

Also, a rotary scan type display device is also conventionally known. Such display device comprises a light emitting cell array and a drive mechanism, such as a motor and so forth, for rotating or pivoting the light emitting cell array in a direction perpendicular to the longitudinal axis of the array. During rotation or pivotal motion, the foregoing display output control similar to the former example is performed for synchronizing the display switching speed with the rotating or pivoting speed. Thus, in the same principle as the former example, an image can be displayed aerially.

In such scan type display device, displaying of arbitrary image may be possible by re-writing the image data stored in the memory of the display control circuit. This may be easily done by image processing technology in a personal computer or so forth. In such case, an image data processed by the microcomputer or so forth may be transferred to the memory in the display control circuit via an appropriate interface. Alternatively, the processed image data may be transferred from the microcomputer or other image data source to the scan type display device in the form of a memory card or a floppy disk and so forth.

However, the above proposed way of re-writing or updating the image data in the memory in the display control circuit is not practical to implement from a viewpoint of costs, since it is inherent to have an expensive image processing system for formulating the image data to be stored and an interface for interfacing between such image processing system and the display device. This is particularly true when the display system is to be incorporated into toys or other inexpensive articles.

SUMMARY OF THE INVENTION

Therefore, it is an object of the present invention to provide a scan type display device which has a function for scanning or reading an image on an original and storing the scanned or read image in the memory.

Another object of the present invention is to provide a scan type display device, in which an image scanning or reading function can be realized at low cost by utilizing a basic function of the scan type display device.

According to one aspect of the invention, a scan type display device having a device body carrying a light emitting cell array, in which a plurality of light emitting cells are aligned on a line, for scanning aerial plane to display a desired image by residual image effect, the light emitting cells being selectively illuminated according to an image data stored in a memory in synchronism with motion of the device body, comprises:

at least one light receiving element provided on the device body, the light receiving element being arranged in a positional relationship with the light emitting cell array in such a manner that, when an image carrying medium containing an image to be sampled is placed in close proximity to the light emitting cell array in opposition and the light emitting cells in the light emitting cell array are selectively illuminated, a reflected light from the image carrying medium is received by the light receiving element for sampling the image on the image carrying medium, and that, when an image carrying medium is placed in close proximity to the light emitting cell array in opposition, each individual light emitting cell being illuminated in order for locally irradiating light on the image carrying medium for reading output of the light receiving element for sampling image data of a linear image fraction, and by relatively shifting the image carrying medium and the light emitting array for repeating sampling of image data for other linear image fraction to establish an image data of the two-dimensional image.

The light receiving element may be placed at one end of the light emitting cell array, and have a field of vision covering the area in front of the light emitting cell array.

The scan type display device may comprise a transparent light guide member having an incident surface extending along the light emitting cell array and a light outgoing surface located in the vicinity of the light receiving element.

In one embodiment of the invention, the display device is a manual scan type display device, in which the device body is held by hand and swung for scanning the light emitting cell array on the aerial display plane. It includes means for detecting relative displacement of the image carrying medium and the light emitting cell array in a direction transverse to the alignment direction of the light emitting cells. The detecting means may comprise a roller rotating according to relative movement between the image carrying medium and the light emitting cell array, and a rotation sensor for detecting rotating angular displacement of the roller.

Alternatively, the detecting means may comprise synchronization mark detecting means for detecting a synchronization mark formed on the image carrying medium. In this case, the device body may be provided at the front portion thereof with a guide along which the medium is shifted relative to the light emitting cell array. The synchronization mark may be a notch formed in the edge of the image carrying medium, and the synchronization mark detecting means may comprise a switch mechanism having a movable strip, the switch mechanism operating in response to the notch by contacting the movable strip onto the edge of the image carrying medium.

In another embodiment of the invention, the display device is a rotary driven scan type display device in which the device body is rotatively driven by a drive mechanism. The image scanning is performed by placing the image carrying medium along the rotational trace of the light emitting cell array and the image on the image carrying medium is scanned by rotating the light emitting cell array. The drive mechanism may be provided with a rotation sensor for detecting rotational angular displacement, and the rotation of the light emitting cell array during image scanning on the image carrying medium is detected by the rotation sensor.

Preferably, the light receiving element is provided in plural. In an example, the number of the light receiving elements may be substantially half of the number of the light emitting cells. In such a case, the light receiving elements are arranged at a pitch double of the pitch of the light emitting cells, and the light receiving element array is located in the vicinity of the light emitting cell array in parallel relationship to the latter.

According to another aspect of the invention, the scan type display device may comprise:

operation fulcrum member mounted on one end of the device body via the device body via a bearing mechanism and rotatable in transverse direction perpendicular to the longitudinal direction of the device body;

rotation detecting means for obtaining an angular position information and an angular speed information of the operation fulcrum member relative to the device body;

display control means for selectively illuminating light emitting cells in the limit emitting cell array according to the image data in synchronism with detection signal of the rotation detecting means; and control means for scanning the image on the image carrying medium by performing light emitting control for the light emitting cells and reading control for reading output of the light receiving element.

According to another aspect of the invention, an aerial display device comprise:

a substantially straight elongated bar form device body;

a light emitting cell array provided on the device body and having a plurality of light emitting cells arranged in alignment;

at least one reflected light receiving element provided on the device body in the vicinity of the light emitting cell array;

a motion sensor detecting physical motion of the device body for generating a motion signal indicative thereof;

a controller including a memory storing an image data to be aerially displayed and operable in a display mode for selectively driving the light emitting cells in a display pattern corresponding to a fractional line pattern of the image to be displayed and varying the display pattern in synchronism with motion of the device body, and in a image scanning mode for scanning fractional line pattern of an image to be sampled by driving the light emitting cell array to sequentially illuminate one of the light emitting cells in order for locally irradiating the light on a point on the fractional line pattern, sampling and holding data indicative of the image in the irradiated point and varying the fractional line pattern to scan in synchronism with relative displacement between the image to be sampled and the light emitting cell array for sampling and holding an image data of a two dimensional image.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The present invention will be discussed in detail in terms of preferred embodiments with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order not to unnecessarily obscure the present invention.

Figure 1:
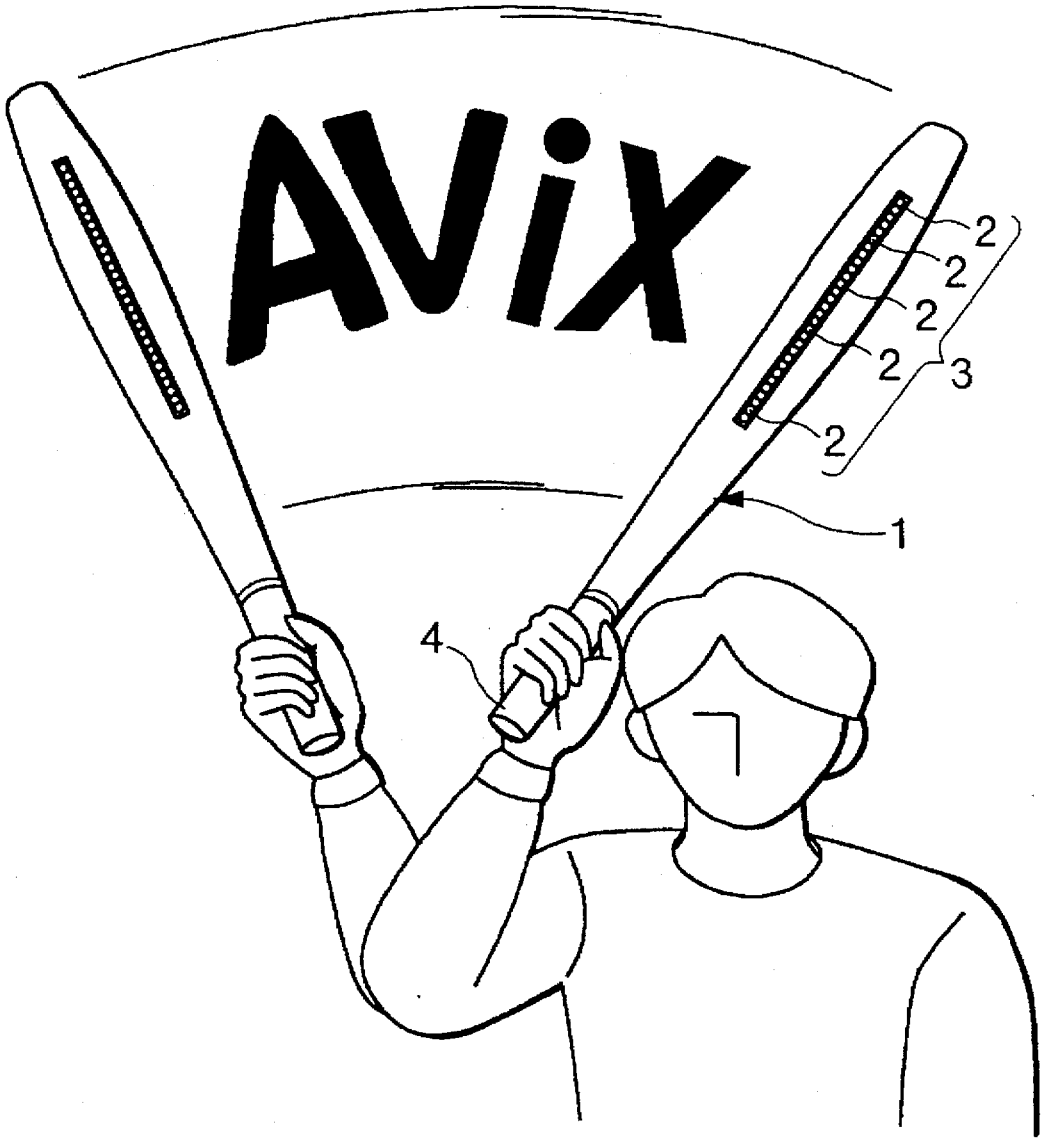
FIG. 1 is an illustration showing a general view of the preferred embodiment of a hand-held scan type display device according to the present invention, which illustrates the manner of use thereof.

FIG. 1 illustrates external appearance and manner of use of the preferred embodiment of a hand-held scan type display device according to the present invention.

As shown in FIG. 1, the scan type display device includes an LED array 3 constituted of a plurality of LED's 2 at the front portion of a bar-shaped main body 1. Within the main body 1, a sensor for detecting a directions of swing motion thereof is disposed. By holding a grip portion 4 at the base of the main body 1, the display device is swung laterally toward left and right, repeatedly. The swing motion is detected by the sensor. A display control circuit in the main body 1 receives the output of the sensor for selectively illuminating the LED's 2 in synchronism with the swing motion to aerially display the desired image. Namely, the display control circuit reads out an image data in a bit map format in a predetermined order per line to line at an appropriate speed for driving the LED's 2 to illuminate and obscure depending on the lighting pattern at respective lines in synchronism with the swing motion of the main body. Then, by the afterimage effect, aerial image can be displayed in the aerial space.

In the present invention, the scan type display device employs a function equivalent to tight fitting type image scanner at low cost. The invention realizes low cost image scanner utilizing the LED array 3 as original irradiating light source. With employment of such built-in image scanning function, the scan type display device according to the present invention can store the image data for the image to be displayed without requiring external source of the image data, as described in detail hereinbelow.

Figure 2:
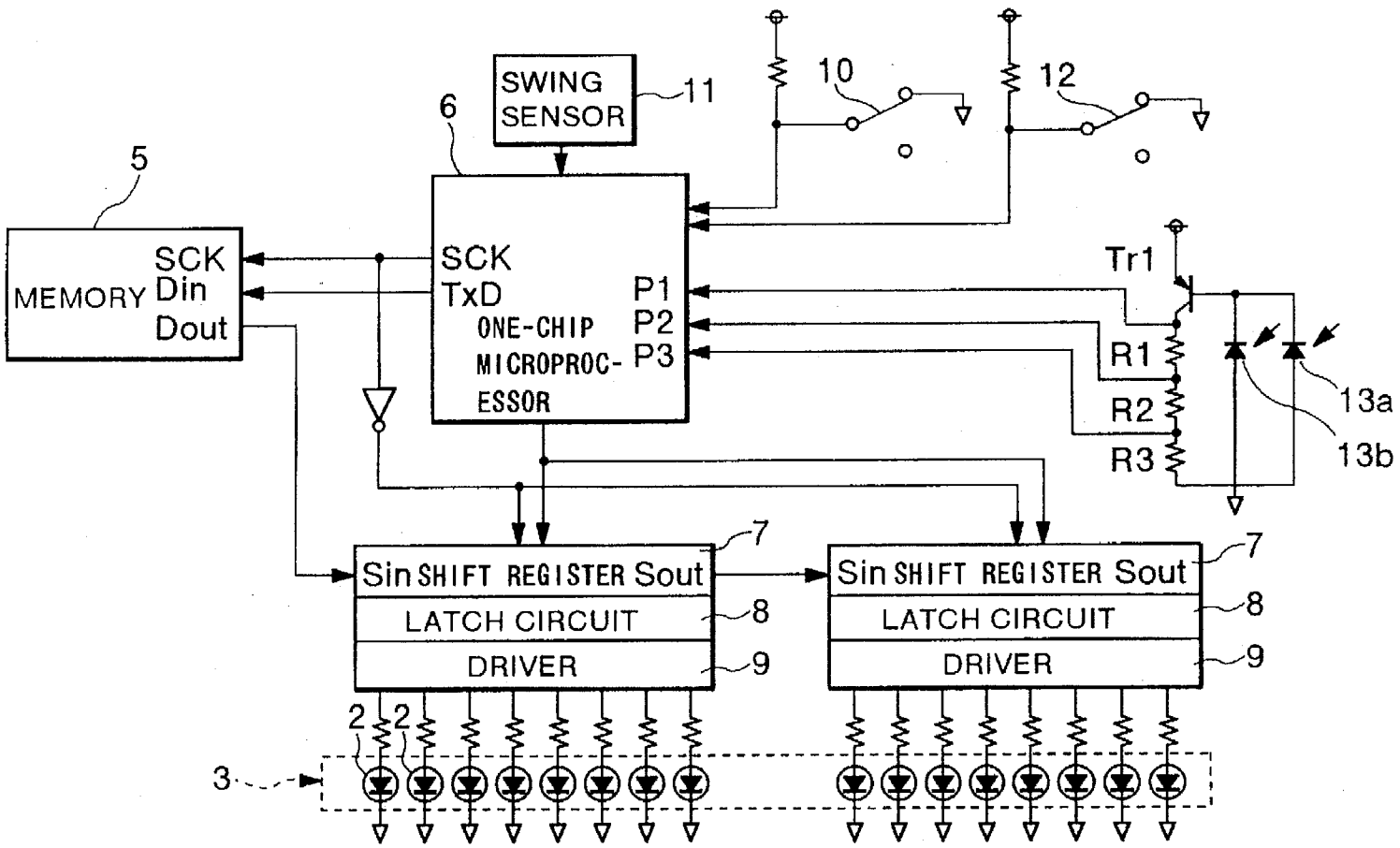
FIG. 2 is a block diagram of a control system employed in the preferred embodiment of the hand-held scan type display device.

FIG. 2 shows a construction of the display control circuit forming a control system for the hand-held scan type display device of FIG. 1. As seen from FIG. 2, the display control circuit includes a one-chip microcomputer 6 coupled with a re-writable memory 5. The memory 5 may be re-writable and non-volatile memory, such as EPROM, EEPROM and so forth. An image data to be displayed is stored in the memory 5. Therefore, the memory 5 should have a memory capacity to store at least one field of image. In the shown embodiment, the one-chip microcomputer 6 performs display control by reading out image data fraction forming one display line or scanning line from the memory 5 in one by one basis and drives respective LED's 2. In addition, the one-chip microcomputer 6 performs image scanning or reading control for image scanning of reading and updating the image data in the memory 5. The operation of the one-chip microcomputer 6 to drive the LED's 2 for displaying image will be hereinafter referred to as "display mode operation", and the operation for scanning or reading image and updating the image data in the memory 5 will be hereinafter referred to as "scanning mode operation". In the display mode operation, the one-chip microcomputer 6 reads out the image data from the memory 5 as serial data and inputs to a series of shift registers 7. The image data is thus shifted through the shift registers 7 and latched by latch circuits 8 respectively associated with respective shift register 7 per predetermined number of bits. By latching respectively predetermined number of bits of image data, the serial image data is converted into parallel image data for one display of scanning line. The parallel image data thus established is transferred to drivers 9 for driving respective individual LED's as light emitting cells, selectively driving them for illumination.

On the other hand, the one-chip microcomputer 6 is connected to a swing sensor 11, a mode selector switch 10, an original secondary scanning detection sensor 12, and light receiving elements (photo diodes) 13*a* and 13*b* for reading an image on the original.

The mode selector switch 10 is a switch to be manually operated by the user for selecting operational mode of the one-chip microcomputer 6. Namely, the mode selector switch 10 can be operated between a display mode position, in which the one-chip microcomputer 6 is active in the display mode for displaying the image on the basis of the image data read out from the memory 5, and a scanning mode position in which the one-chip microcomputer 6 is active in performing image scanning to read the image on the original and update the image data in the memory 5. The swing sensor 10 monitors swing motion of the main body as illustrated in FIG. 1, and outputs a swing detection signal representative of the swing speed and swing direction. In the display mode, the one-chip microcomputer 6 performs display timing control for enabling displaying of respective display or scanning lines of image in synchronism with the swing motion.

The manner of synchronous control of the display timing of respective display lines of image data relative to swing motion of the main body has been disclosed in detail in the above-identified European Patent First Publication No. 05 46 844 and U.S. patent application Ser. No. 07/991,547, the whole disclosure of which are herein incorporated by reference for the sake of disclosure.

When the mode selector switch 10 is in the scanning mode, the one-chip microcomputer 6 is active to turn ON each individual LED 2 in one-by-one basis for emitting light toward the original containing the image to be scanned, the original being placed just in front of the LED array 3 prior to this operation. The light reflected from the original is detected by the light receiving elements 13*a* and 13*b*. Then, the one-chip microcomputer 6 reads out the outputs of the light receiving elements 13*a* and 13*b* as respective pixel data. By aligning the pixel data thus read out, the one-chip microcomputer 6 forms a linear image data for one display line. The original secondary scanning detection sensor 12 detects shifting of the original in a direction perpendicular to the alignment direction of the LED array 3 to output a secondary scanning detection signal. The one-chip microcomputer 6 is responsive to the secondary scanning detection signal to terminate sampling of the pixel data for the current display line and start sampling and aligning of the pixel data for the next display line. By repeating these processes, linear image data for all display lines or scanning lines is sampled to formulate a two dimensional image data. After completion of formation of the two dimensional image data, the one-chip microcomputer 6 writes in the image data thus generated to the memory 5.

Figure 3:
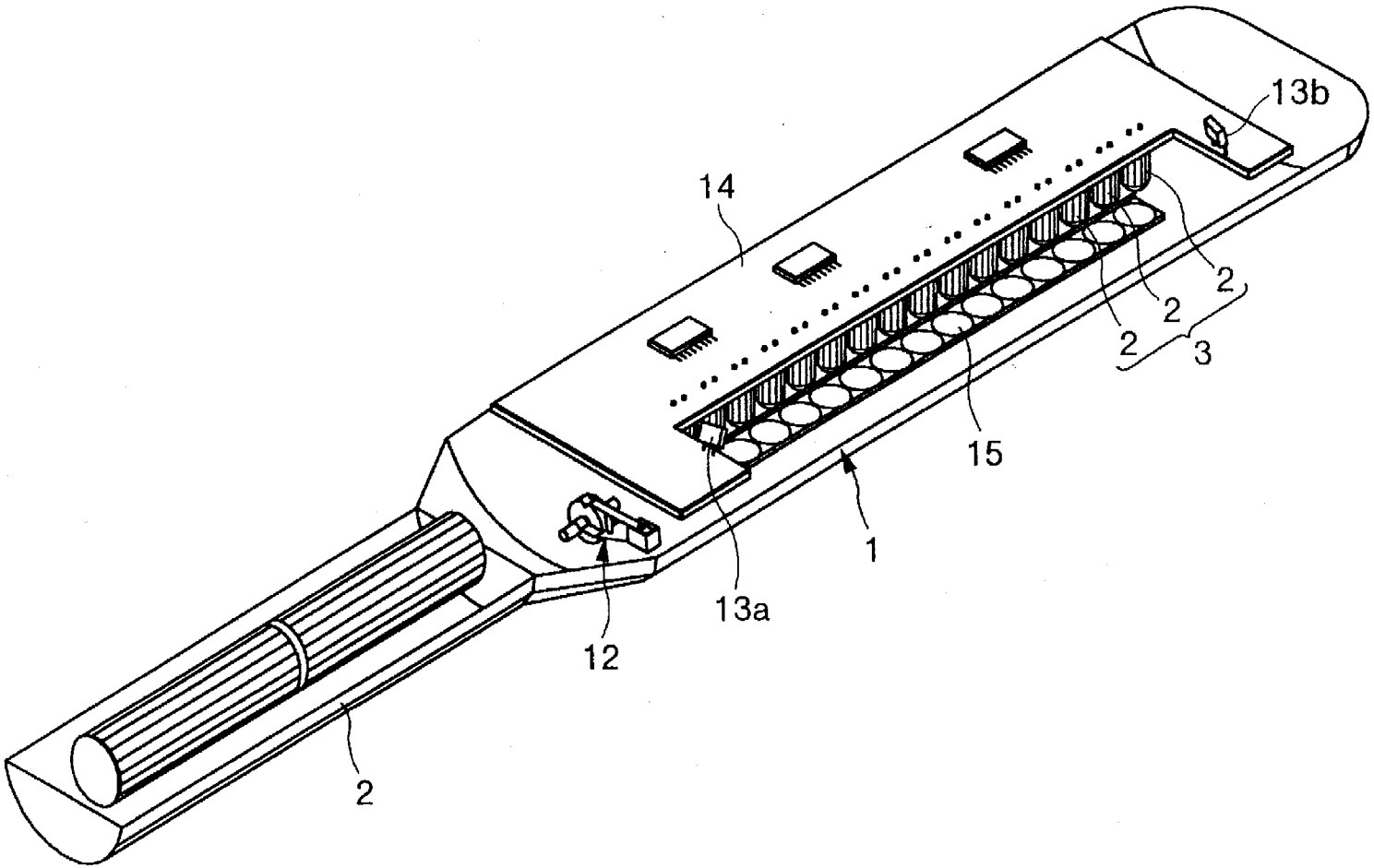
FIG. 3 is a exploded perspective view showing an internal construction of the preferred embodiment of the hand-held scan type display device.
Figure 4:
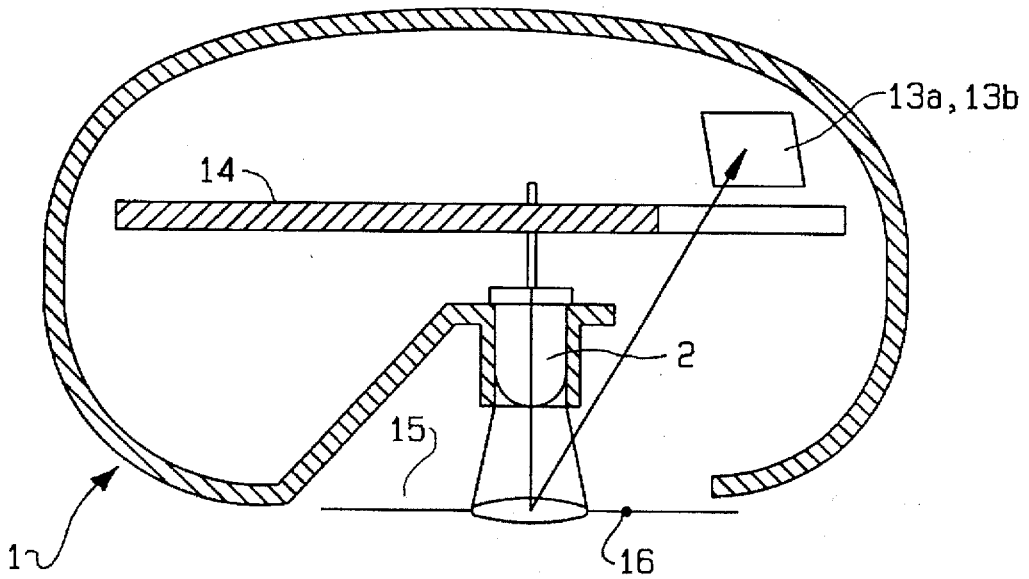
FIG. 4 is a cross section of the preferred embodiment of the hand-held scan type display device, showing an arrangement of an optical system.

Further detailed discussion will be given for construction and operation of the image scanning system. FIGS. 3 and 4 show a positional relationship between the LED array 3 and the light receiving elements 13*a* and 13*b* within the main body 1. LED's 2 are aligned on the surface of a printed circuit board 14 housed within the main body 1. Each individual LED 2 is oriented to have an light axis directed outwardly through a front window portion 15. Along one side of the LED array 3, the printed circuit board 14 is cut out so that an incident light into the main body through the front window 15 may reach the backside of the printed circuit board 14. In the vicinity of both transverse edges of the cut out, the light receiving elements 13*a* and 13*b* are arranged on the back side of the printed circuit board 14. The light receiving elements 13*a* and 13*b* are oriented in oblique so as to capture any light coming through the front window.

With the arrangement set forth above, the following optical positional relationship is established. As shown in FIG. 4, at a condition where the original 16 is placed to cover the front window 15, one of the LED 2 in the LED array 3 is illuminated. Then, the light from the illuminated LED 2 is irradiated on the original 16 and a reflected light is returned from the original 16 into the main body 1 through the front window 15. A part of the reflected light is then incident on the light receiving elements 13*a* and 13*b* as shown by the arrow.

When one LED 2 is illuminated, the light is locally irradiated on the original 16 and the reflected light from the locally irradiated position is received by the light receiving elements 13*a* and 13*b*. The light intensity of the reflected light as received by the light receiving elements 13*a* and 13*b* is differentiated depending upon the image on the locally irradiated position. Therefore, the output level of the light receiving elements 13*a* and 13*b* is differentiated depending upon black or white of the image at the locally irradiated position. Thus, black and white of the image at the locally irradiated position can be recognized by comparing the output levels of the light receiving sensors 13*a* and 13*b* with a predetermined threshold serving as black and white criterion. As a result, a digital pixel data representative of black or white image corresponding to the locally irradiated position can be attained by the one-chip microcomputer 6. Sampling of the pixel data is repeated by sequentially illuminating each one of the LED 2 in order. By sampling the pixel data for all of the LED's 2 (in the shown embodiment, sixteen LED's 2 are employed for forming the LED array 3), the linear image on the original 16 for one display line is separated into sixteen pixel data to be assigned for respective LED's 2 in the LED array 3.

As shown in FIG. 2, two light receiving elements 13*a* and 13*b* are connected in parallel to the one-chip microcomputer 6 via a pre-amplifier constituted of a transistor Tr and resistors R1, R2 and R3. As set forth above, respective of the light receiving elements 13*a* and 13*b* may cover entire area of the front window 15 to receive any incident light therethrough by oblique orientation thereof. As can be appreciated, the light sensitivity of each light receiving element 13*a* and 13*b* becomes maximum at the center of the field of vision thereof. The light receiving elements 13*a* and 13*b* are so oriented as to have the maximum sensitivity axes directed to the distal portion (i.e. a portion closer to the other light receiving element at the opposite side, as compared to the center of the front windows 15), and to have relatively low sensitivity at the area close to own position. With the directionality of the light receiving elements 13*a* and 13*b* and the orientations thereof, the sensitivity level of the light receiving elements becomes substantially uniform at entire area of the front windows 15.

Despite of the directionality and the orientation of the light receiving elements 13*a* and 13*b*, it is still difficult to establish completely uniform sensitivity for the entire area of the front windows 15. To this end, there are established a first reading path (input port P3) for encoding the received light level of an output from the lowermost position of a resistor ladder circuit R1, R2 and R3 of the pre-amplifier and reading out the binary data, a second reading path (input port P2) for encoding the received light level of an output from the intermediate position in the pre-amplifier and reading out the binary data, and a third reading path (input port P1) for encoding the received light level of the output from the uppermost position of the pre-amplifier and reading our the binary data. One of the first to third paths is selected depending upon the position of the LED 2 illuminated. Associated with this, the threshold level is variable relative to the selected reading path so that the sensitivity in scanning the image can be further unified.

The construction and operation in case of scanning of the two-dimensional image will be discussed. In order to scan or read the two-dimensional image, the foregoing linear scanning operation is performed with intermittently shifting the original 16 relative to the front windows 15 for a predetermined magnitude in a direction perpendicular to the alignment direction of the LED array 3. This is referred to as secondary scan. With effecting the secondary scan in synchronism with the linear scan set forth above, the two-dimensional image can be scanned or read. In the practical operation, the original 16 may be placed on a flat plane such as on a desk, and then the front windows 15 of the main body 1 is mated with the original 16 in the proximity to the latter. Then, the main body 1 is shifted in a direction transverse to the alignment direction of the LED array 3. At this time, the original secondary scanning detection sensor 12 detects shifting of the main body 1 in transverse direction relative to the original 16 and outputs the secondary scan detection signal. The one-chip microcomputer 6 performs the linear scanning operation at every occurrence of the secondary scan detection signal.

Figure 6:
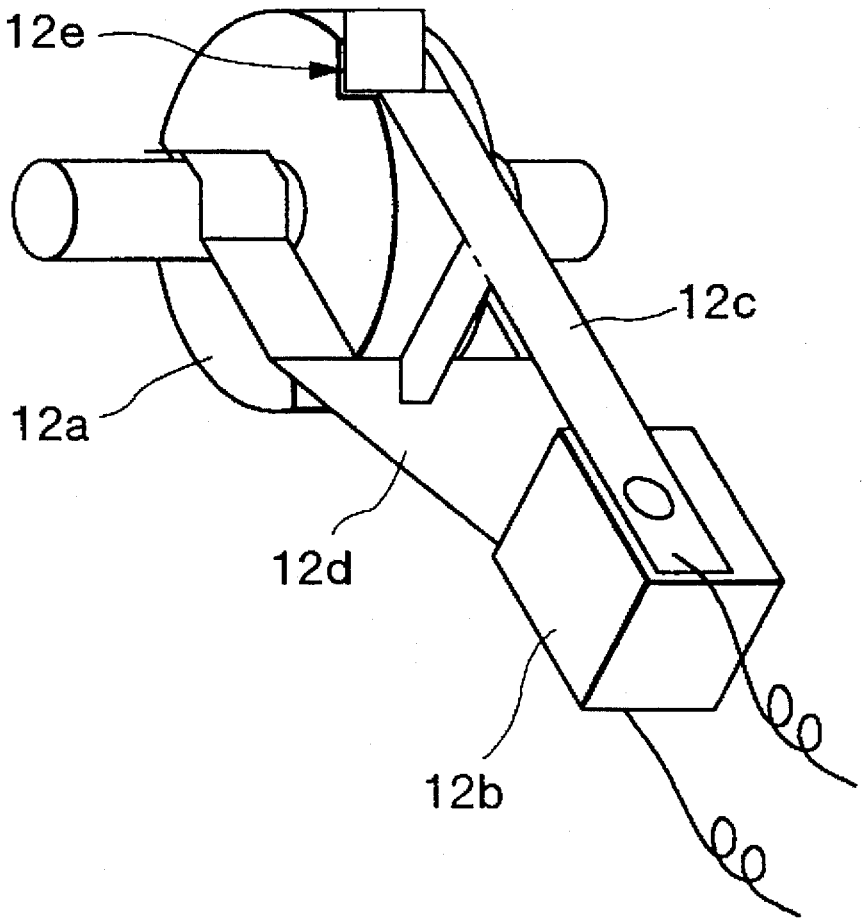
FIG. 6 is a perspective view showing a detail of an original secondary scanning detecting sensor in the hand-held scan type display device.

FIG. 6 shows the detailed construction of the original secondary scanning detection sensor 12 in FIG. 3. As shown, the original secondary scanning detection sensor 12 includes a rotary roller 12*a* contacting with the original 16 and rotatable according to relative movement of the main body 1 and the original 16, and a switch constituted of a movable contact 12*c* of a leaf spring mounted on a base block 12*b* and a stationary contact 12*d*. A notch 12*e* is formed on the outer periphery of the roller 12*a*. The tip end of the movable contact 12*c* is urged to the outer periphery of the roller 12*a* by the spring force thereof. At every given angle of rotation of the roller 12*a*, the tip end of the movable contact 12*c* falls into the notch 12*e*. At this position, the switch constituted of the movable contact 12*c* and the stationary contact 12*d* is turned OFF. Namely, at every predetermined magnitude of transverse shifting of the original 16, the output of the original secondary scanning detection sensor 12 is turned ON and OFF. With taking this ON/OFF signal, the one-chip microcomputer 6 performs image processing operation to sequentially stored the scanned or read image data in the memory 5.

Figure 5:
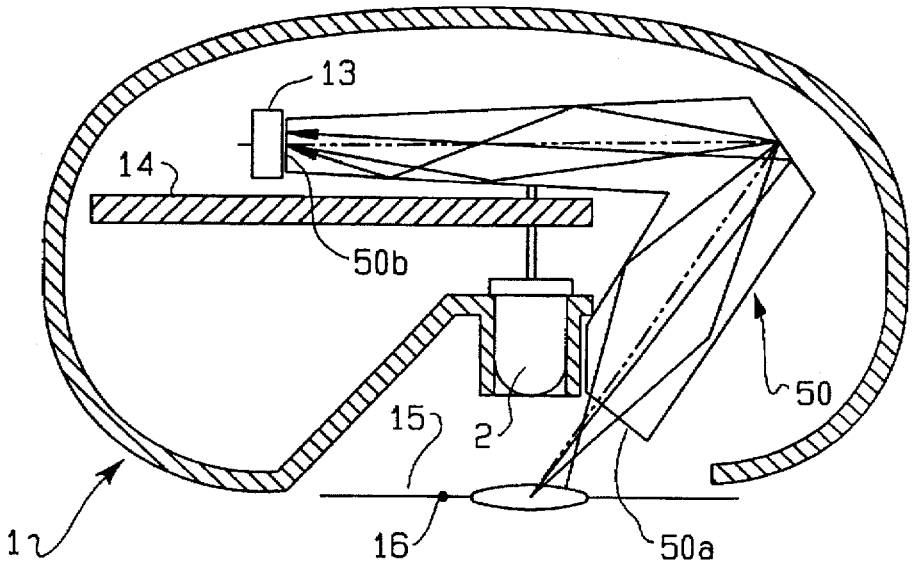
FIG. 5 is a cross section of another embodiment of the arrangement of the optical system to be employed in the hand-held scan type display system according to the invention.

Next, discussion will be given for another embodiment of the present invention. Another embodiment of the positional relationship between the LED array 3 and the light receiving element is shown in FIG. 5. In the shown embodiment, one light receiving element 13 is mounted on the back side of the printed circuit board Also, a transparent plastic light guide member 50 is mounted in the main body 1. The light guide member 50 has a incident surface 50*a* extending in parallel with the LED array 3. The incident surface 50*a* is adjacent to the LED array 3 and faces the front windows 15. The other end of the light guide member 50 is tapered to terminate at an outgoing surface 50*b* which is opposed to the light receiving surface of the light receiving element 13 and positioned in the proximity to the latter. By this optical positional relationship, when the original 16 is placed to cover the front windows 15 and one LED 2 is illuminated, the light emitted from the LED 2 is irradiated onto the original and reflected. The reflected light incides through the front window. A part of the reflected light reaches the light receiving element 13 via the light guide member 50 as shown by an arrow.

Figure 7A:
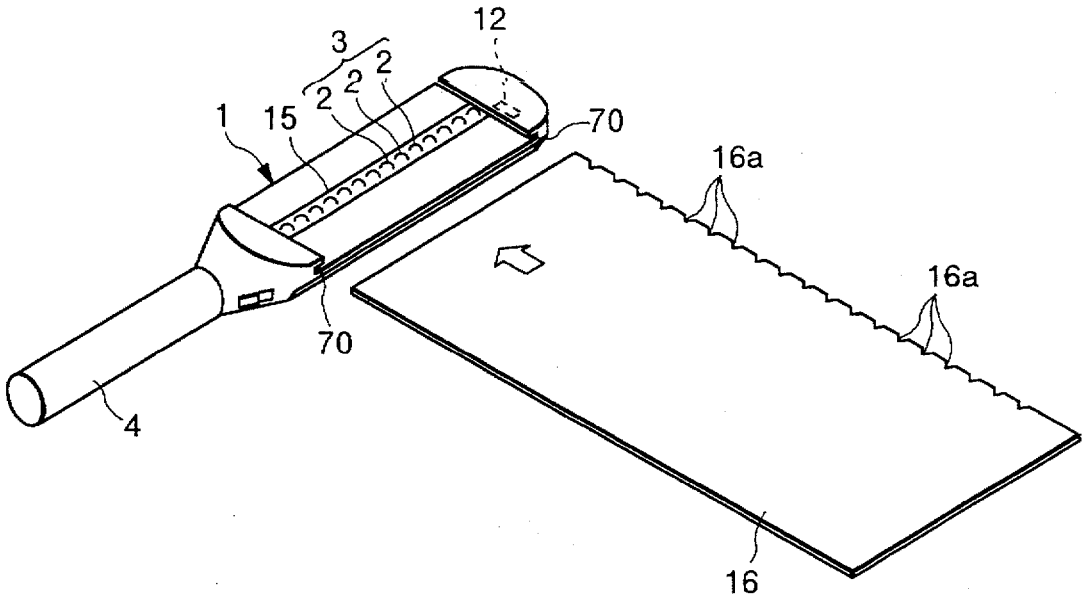
FIGS. 7(A) and 7(B) are perspective view and partial section of the major part of another embodiment of the original secondary scanning detecting sensor in the hand-held scan type display device.

FIG. 7(A) shows another embodiment of the original secondary Scanning detection means. In the embodiment of FIG. 7(A), two opposite guide grooves 70 for the original 16 are formed on the front surface of the main body 1. The guide grooves 70 are formed in the vicinity of both ends of the LED array 3, respectively, and extends in a direction perpendicular to the alignment direction of the LED array. The original 16, which has a width substantially corresponding to the distance between the guide grooves 70, is inserted therebetween and is moved along the guide grooves 70 until the entire of the original 16 passes through the main body 1. With such operation, the original is shifted with maintaining mating relationship with the front windows 15. It is desirable to provide a plurality of notches 16*a* at a constant pitch along one edge of the original 16. Correspondingly, within one of the guide members 70 receiving the one edge of the original having the notch, the secondary scanning detection sensor 12 is provided so that the shifting of the original 16 can be detected by detecting the notches 16*a*.

Figure 7B:
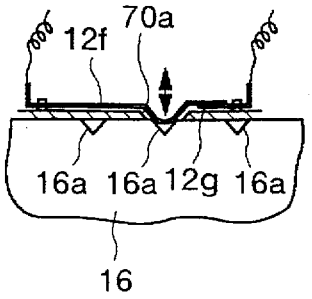

As shown in FIG. 7(B), the secondary scanning detection sensor 12, in the shown embodiment, comprises a movable contact 12*f* mounted inside of the side wall of the guide groove 70 and a stationary contact 129. A hole 70*a* is formed on the side wall of the guide groove 70. The movable contact 12*f* formed of a leaf spring has a curved portion slightly extending outwardly through the hole 70*a*. When the original 16 is moved along the guide grooves 70, the curved portion of the movable contact 12*f* contacts with the side edge of the original 16 so that the curved portion thereof is deformed as shown by arrow at every notch 16*a* on the side edge of the original 16, resulting in turning the switch ON and OFF.

In the foregoing embodiments, the notch 16 of the original 16 serves as mechanical synchronization mark, and the secondary scanning detection sensor constituted of the movable contact 12*f* and the stationary contact 12*g* serves as a synchronization mark detecting means. However, the synchronization mark is not limited to the mechanical structure but can be magnetically perceptible mark, optically perceptible mark and so forth. In such case, the secondary scanning detection sensor may be a magnetoelectric sensor, optoelectric sensor or so forth.

Figure 8:
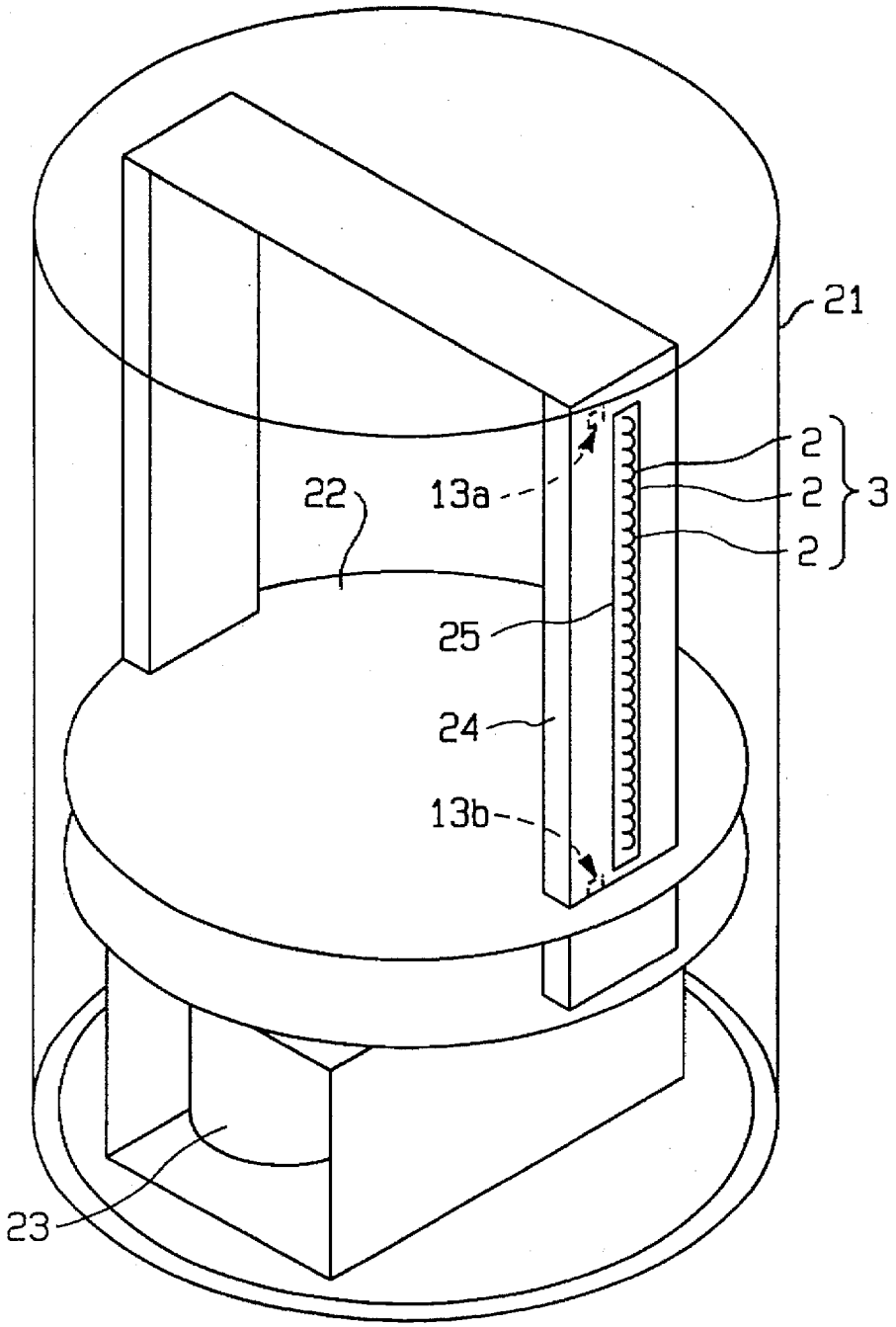
FIG. 8 is a perspective view showing general construction of a rotary scan type display device, to which the present invention is applied.

Next, the embodiment, in which the present invention is applied for a rotary scan type display device, will be discussed with reference to FIGS. 8 and 9. The device shown in FIG. 8 is housed in a transparent casing 21. Within the transparent casing 21, a rotary disk assembly 22 driven by a motor 23 is housed rotatable. A main body 24 of a display device is vertically secured on the rotary disk assembly 22. The main body 24 has substantially the same construction to that disclosed with respect to the embodiment of FIGS. 3 and 4. Specifically, a slit-like front window 25 is defined in the front surface of the main body 24, and the LED array 3 is disposed inside the front window 25. Also, light receiving elements 13*a* and 13*b* are mounted adjacent to respective ends of the LED array 3 on a printed circuit board housed within the main body 24. The positions and orientations of the light receiving elements 13*a* and 13*b* relative to the LED array 3 is the same as that illustrated in FIGS. 3 and 4. Namely, when one LED 2 is illuminated in the condition where the original 16 is just in front of the front window 25 across the transparent casing 21, the light emitted from the illuminated LED 2 is locally irradiated on the original 16. The reflected light from the original incides into the transparent casing 21 and thus enters into the main body 24. Then, a part of the reflected light reaches the light receiving elements 13*a* and 13*b*.

Figure 9:
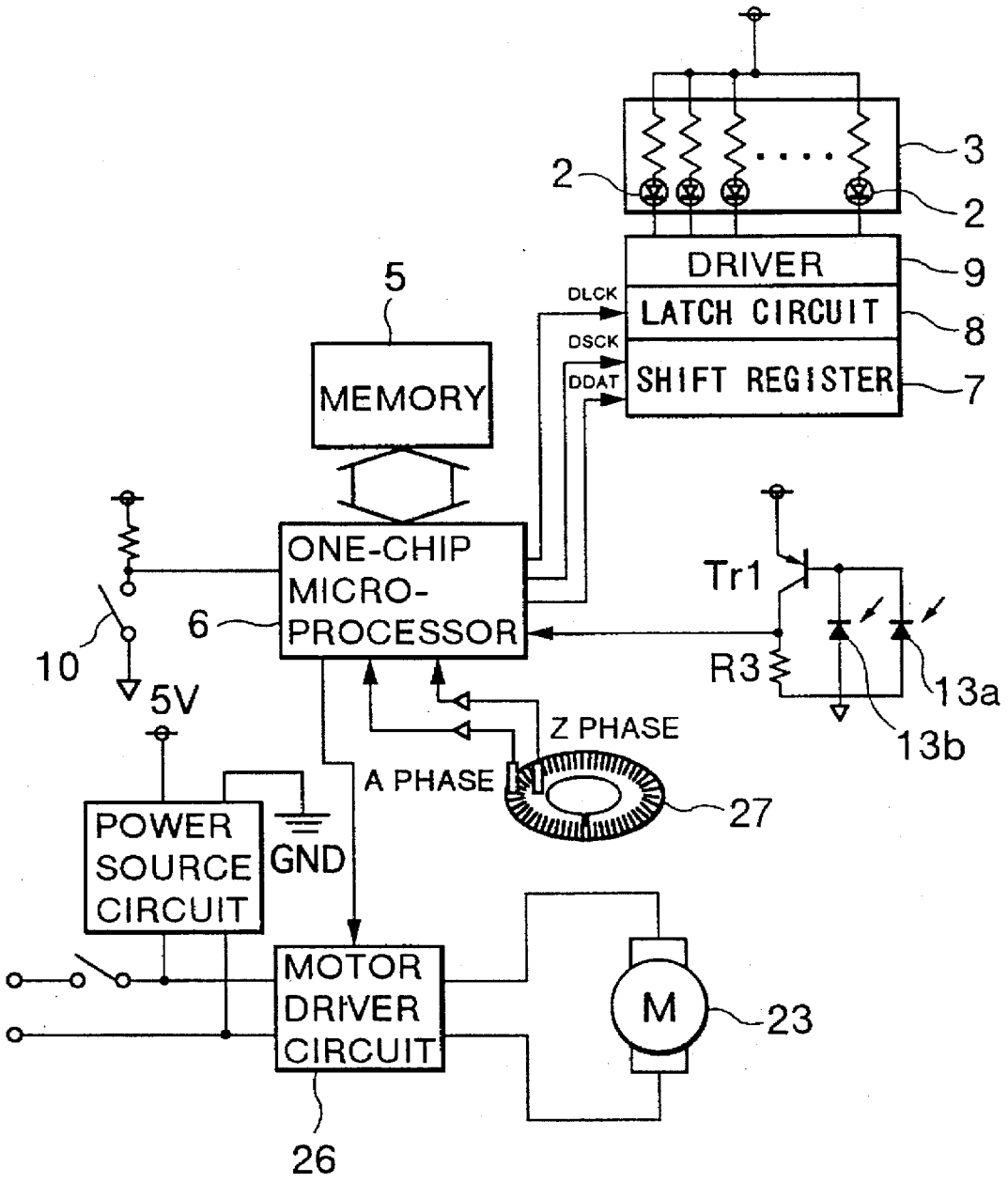
FIG. 9 is a block diagram showing a control system of the rotary scan type display device.

Construction of the control system shown in FIG. 9 is also similar to that of FIG. 2. Namely, the control system includes the one-chip microcomputer 6 performing overall control, a memory 5 for storing the image data, the shift register 7 and latch circuit 8 for selectively driving respective LED's 2 in the LED array 3 for illumination, the driver 9, the mode selector switch 10, the pre-amplifier (Tr1 and R3) for the light receiving elements 13*a* and 13*b*. In addition, the control system includes a circuit for driving the motor 23, and a rotation sensor (rotary encoder) 27 for detecting angular displacement of the rotary disk assembly 22. The one-chip microcomputer 6 performs the following processes in synchronism with the output signal of the rotation sensor 27.

In the display mode, the one-chip microcomputer 6 drives the motor 23 at high speed and reads out the image data from the memory 5 for transferred to the display output system (shift register 7, latch circuit 8 and driver 9) with taking the output signal of the rotation sensor 27 as a synchronization signal to selectively drive respective LED's 2 in the LED array 3. By this, an image is displayed on the cylindrical surface as rotational trace of the main body 24.

In the scanning mode, at first, the original containing the image to be scanned or read is attached onto the outer peripheral surface of the transparent casing 21 with placing the image inside. Then, the device is operated in the scanning mode. The one-chip microcomputer 6 drives the motor at predetermined low speed. In conjunction therewith, in synchronism with the output of the rotation sensor 27, scanning or reading process is performed. Namely, each of the LED's 2 in the LED array 3 is illuminated in order to locally irradiate the original. Then, the reflected light from the original is detected by the light receiving elements 13*a* and 13*b*. The light receiving elements 13*a* and 13*b* generates a binary signal depending upon the intensity level of the reflected light. By illuminating all LED's 2 in one-by-one basis, linear image scanning can be performed. This linear image scanning operation is repeated at every predetermined angle of angular displacement of the rotary disk assembly 22 carrying the main body 24. By this, the overall area of two dimensional image can be scanned and stored as the binary image data in the memory 5.

Figure 10:
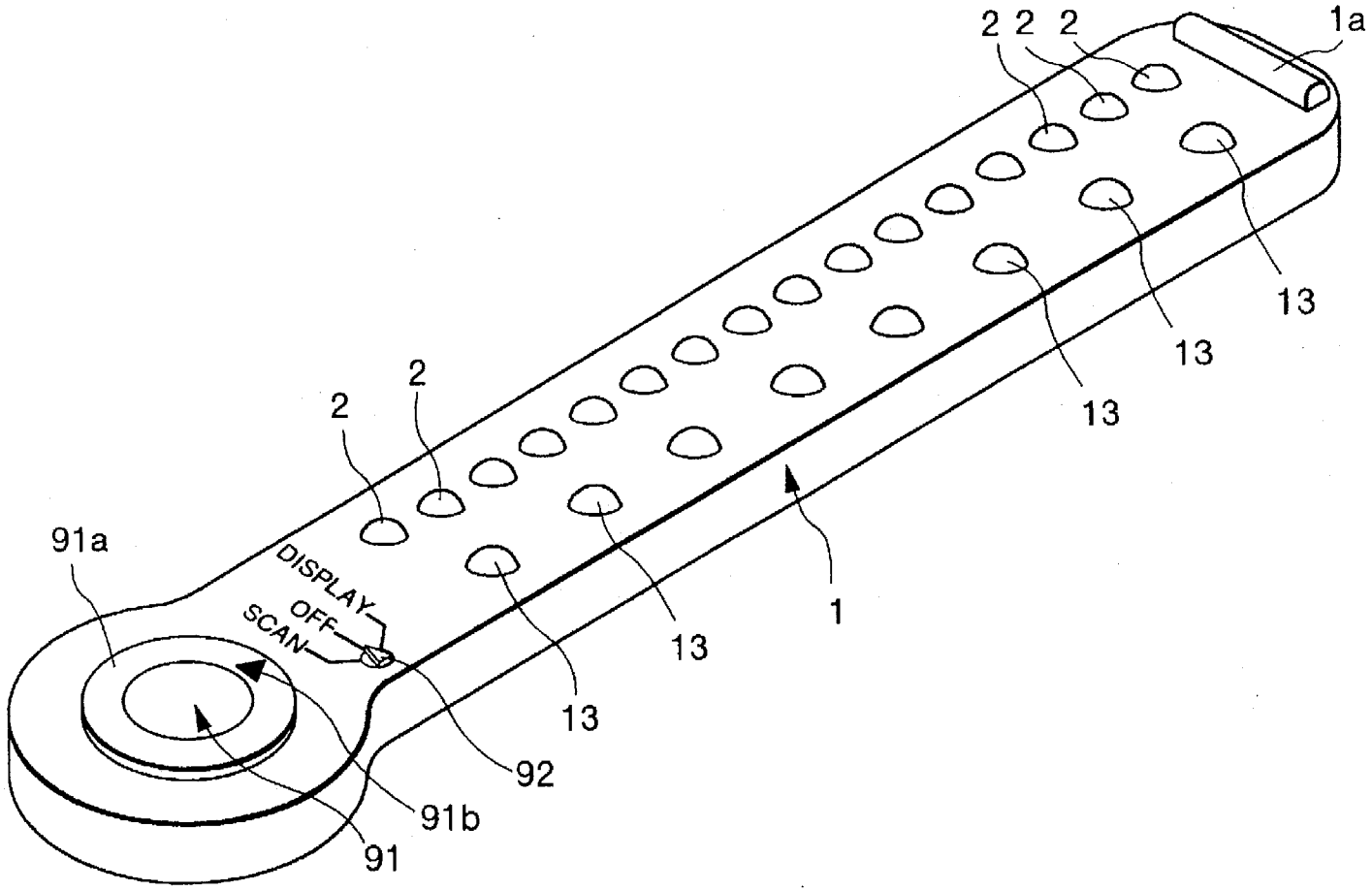
FIG. 10 is an external appearance of the hand-held rotational scan type display device, to which the present invention is applied.
Figure 11:
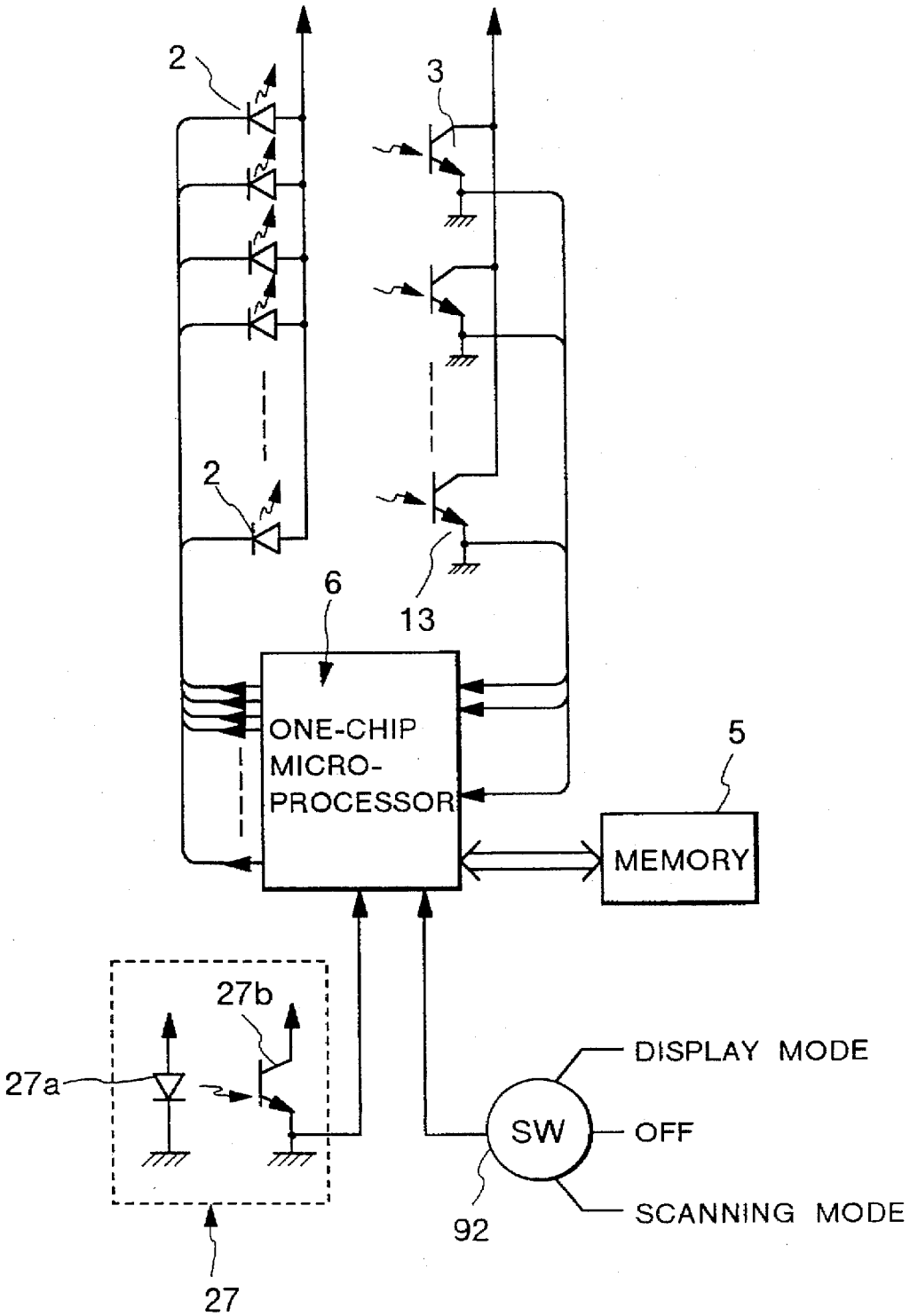
FIG. 11 is a block diagram of a control system of the hand-held scan type display device of FIG. 10.

FIGS. 10 and 11 shows a further embodiment of the present invention, which relates to a manual rotational scan type display device. As shown in FIG. 10, the main body 1 has a configuration like a flat bar. On the front surface of the main body 1, a plurality of (sixteen in the shown embodiment) of LED's 2 are arranged in a constant pitch in alignment. In parallel to the LED array 3, eight light receiving elements 13 are provided in alignment. The aligned LED array 3 and the aligned array of the light receiving elements 13 are placed in a spaced apart positional relationship. In the practical construction, the pitch of arrangement of the light receiving elements 13 is set at double of the arrangement pitch of the LED's 2. Specifically, each light receiving element 13 is located adjacent to a pair of LED's 2.

As a fulcrum member for rotational operation in manual scanning of the display device, the main body 1 is provided with a rotary ring 91 at the base portion. The rotary ring 91 is rotatable relative to the main body 1 and the internal diameter of the rotary ring 91 is designed to accommodate a finger. When using this display device, a user inserts a finger through the rotary ring 91, and the finger is oriented substantially in horizontal direction. At this condition, the main body 1 is placed in the loosely hanged position. Then, by moving the finger in circular fashion, such that a circle is drawn by the tip of the finger, the main body 1 is driven to rotate about the finger inserted through the rotary ring 91. At this time, the rotary ring 91 is fixedly secured to the finger, and the main body 1 is rotated about the rotary ring 91. The rotary ring 91 allows the rotational movement of the main body 1, as set forth above.

In order to detect the angular displacement of the rotary ring 91 relative to the main body 1, a rotary sensor having substantially the same construction as the rotary sensor 27 in the embodiment of FIG. 9 is provided. As shown in FIG. 11, the rotary sensor 27 includes a light emitting diode (LED) 27*a* and a photo transistor 27*b*. The LED 27*a* and the photo transistor 27*b* are arranged in opposition to a rotary marker plate (not shown) rotatable with the rotary ring 91 for optoelectrically detecting the rotational motion of the rotary marker plate.

Also, as shown in FIG. 11, control and signal processing of the device including illumination control for selectively driving the LED for selective illumination thereof, and reading control for reading the outputs of the light receiving elements 13*a* and 13*b*, are all done by the one-chip microcomputer 6. A switch 92 serves as a power switch of the device, and also serves as a mode selector switch. Thus, the switch 92 outputs a signal indicative of the selected operational mode of the one-chip microcomputer 6. As set forth, by the operation of the switch 92, the operational modes and the scanning modes are switched.

In the display mode, associated with relative rotation of the rotary ring 91 to the main body 1, the output signal of the rotation sensor 27 is varied. The rotation detection signal is input to the one-chip microcomputer 6 as a reference signal. The one-chip microcomputer 6 sequentially reads out the bit map format image data from the memory 5. According to the read out image data, LED's 2 are controlled for selective illumination in time division manner. As a result, an image can be aerially displayed by the residual image effect in synchronism with rotation (i.e. angular position and the velocity) of the main body about the finger by rotary scanning.

In the scanning or reading out mode, by drawing or printing picture or character on an appropriate medium, the display device is arranged on the medium (original) at an orientation where the LED array 3 and the array of the light receiving elements 13 are opposed to the medium. A flange 91*a* of the rotary ring 91 is projected from the surface of the main body and a projection 1*a* is provided at the tip end of the main body, so that an appropriate distance can be maintained between the medium and the LED and light receiving element arrays. The light emitted from the LED 2 and reflected from the medium can be received by the light receiving element 13. Reading is performed by sequentially illuminating the LED's 2 in one-by-one basis. As set forth above, since each light receiving element 13 is corresponded to two LED's 2, the output of the light receiving element 13 is read only when the corresponding one of the LED's is illuminated. Namely, when the first LED is illuminated, the output of the corresponding first light receiving element 13 is read. Also, when the second LED is illuminated, the output of the corresponding first light receiving element 13 is also read. However, when the third LED is illuminated, the output of the second light receiving element 13 which corresponds to the third and fourth LED's is read. In the similar manner, subsequent LED's are illuminated in order and outputs of the corresponding light receiving elements are read. Therefore, the linear image for one display line is sampled as sixteen dot image data.

For scanning two-dimensional image, a direction mark 91*b* on the rotary ring 91 is aligned with a scanning start line direction. Then, the rotary ring 91 is fixed in place by a finger. Thereafter, the main body 1 is rotated about the rotary ring 91 at relatively low speed within a desired angular range. At this time, the rotation detection signal is generated by the rotation sensor 27. The one-chip microcomputer 6 is thus operated in response to the rotation detection signal for performing sampling of the linear images at respective predetermined angular positions in synchronism with motion of the main body. Thus, bit map format image data having respectively sixteen dot pixel data can be obtained.

With the construction set forth above, the present invention realizes the scan type display device which can store or re-write the image data for the image to be displayed without requiring any external image data source, by employing the image scanning function. Furthermore, the present invention realizes the image scanning function as low cost built-in function.

Although the invention has been illustrated and described with respect to exemplary embodiment thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodies within a scope encompassed and equivalents thereof with respect to the feature set out in the appended claims.

What is claimed is:

1. A scan type display device comprising a device body carrying a light emitting cell array including a plurality of light emitting cells arrange in a linear alignment for scanning an aerial plane to display a desired image by utilizing a residual image effect, said light emitting cells being selectively illuminated according to image data stored in a memory and in synchronism with motion of said device body, said display device further comprising:

light receiving means including at least one light receiving element provided on said device body, said light receiving element being positioned to receive a reflected light from a to-be-sampled image displayed on an image carrying medium, when such image is placed in proximity and in opposition to said light emitting cell array and is illuminated by said light emitting cells;

means for illuminating each individual light emitting cell of said light emitting array in a predetermined order for sampling line image data of a single display line of such to-be-sampled image; and means for detecting shifting of such to-be-sampled image so as to terminate sampling of line image data of a previous display line of such to-be-sampled image and to sample line image data of a next display line of such image.

2. A scan type display device as set forth in claim 1, wherein said light receiving element is placed at one end of said light emitting cell array, said light receiving element having a field of vision covering the area in front of said light emitting cell array.

3. A scan type display device as set forth in claim 1, which further comprises a transparent light guide member having an incident surface extending along said light emitting cell array and a light outgoing surface located in the vicinity of said light receiving element.

4. A scan type display device as set forth in claim 1, wherein the display device is a manual scan type display device, said device body being held by hand and swung for scanning said light emitting cell array on the aerial display plane.

5. A scan type display device as set forth in claim 4, wherein said means for detecting shifting of such to-be-sampled image include means for detecting relative displacement of said image carrying medium and said light emitting cell array in a direction transverse to the alignment direction of said light emitting cells, said detecting means comprising a roller rotating according to relative movement between said image carrying medium and said light emitting cell array, and a rotation sensor for detecting rotating angular displacement of said roller.

6. A scan type display device as set forth in claim 4, wherein said means for detecting shifting of such to-be-sampled image include means for detecting relative displacement of said image carrying medium and said light emitting cell array in a direction transverse to the alignment direction of said light emitting cells, said detecting means comprising synchronization mark detecting means for detecting a synchronization mark formed on said image carrying medium.

7. A scan type display device as set forth in claim 6, wherein said device body is provided at the front portion thereof with a guide along which said medium is shifted relative to said light emitting cell array.

8. A scan type display device as set forth in claim 7, wherein said synchronization mark is a notch formed in the edge of said image carrying medium, and said synchronization mark detecting means comprises a switch mechanism having a movable strip, said switch mechanism operating in response to said notch by contacting said movable strip onto the edge of said image carrying medium.

9. A scan type display device as set forth in claim 1, wherein the display device is a rotary driven scan type display device in which said device body is rotatively driven by a drive mechanism.

10. A scan type display device as set forth in claim 9, wherein the image scanning is performed by placing said image carrying medium along the rotational trace of said light emitting cell array and the image on said image carrying medium is scanned by rotating said light emitting cell array.

11. A scan type display device as set forth in claim 10, wherein said drive mechanism is provided with a rotation sensor for detecting rotational angular displacement, and the rotation of said light emitting cell array during image scanning on said image carrying medium is detected by said rotation sensor.

12. A scan type display device as set forth in claim 1, wherein said light receiving elements are provided in plural with the number being substantially half of the number of said light emitting cells, said light receiving elements are arranged at a pitch double of the pitch of said light emitting cells, and said light receiving element array is located in the vicinity of said light emitting cell array in parallel relationship to the latter.

13. A scan type display device as set forth in claim 1, further comprising:

an operation fulcrum member mounted on one end of said device body by a bearing and rotatable around an axis perpendicular to the longitudinal direction of said device body;

rotation detecting means for obtaining an angular position information and an angular speed information of said operation fulcrum member relative to said device body;

display control means for selectively illuminating light emitting cells in said light emitting cell array according to said image data in synchronism with detection signal of said rotation detecting means; and control means for scanning the image on said image carrying medium by performing light emitting control for said light emitting cells and reading control for reading output of said light receiving element, in synchronism with detection signal of said rotation detecting means during rotation of said device body on the image carrying medium.

14. An aerial display device comprising:

a substantially straight elongated bar form device body;

a light emitting cell array provided on said device body and having a plurality of light emitting cells arranged in alignment;

at least one reflected light receiving element provided on said device body in the vicinity of said light emitting cell array;

a motion sensor detecting physical motion of said device body for generating a motion signal indicative thereof;

a controller including a memory storing an image data to be aerially displayed and operable in a display mode for selectively driving said light emitting cells in a display pattern corresponding to a fractional line pattern of the image to be displayed and varying the display pattern in synchronism with motion of said device body, and in a image scanning mode for scanning fractional line pattern of an image to be sampled by driving said light emitting cell array to sequentially illuminate one of said light emitting cells in order for locally irradiating the light on a point on the fractional line pattern, sampling and holding data indicative of the image in the irradiated point and varying the fractional line pattern to scan in synchronism with relative displacement between the image to be sampled and the light emitting cell array for sampling and holding an image data of a two dimensional image.

* * * * *